US005109205A

United States Patent [19]

Hart et al.

[11] Patent Number: 5,109,205

[45] Date of Patent: Apr. 28, 1992

[54] MILLIMETER WAVE MICROSTRIP SHUNT-MOUNTED PIN DIODE SWITCH WITH PARTICULAR BIAS MEANS

[75] Inventors: Rebecca A. Hart, Plymouth; John R. Lamberg, Minnetonka, both of Minn.

[73] Assignee: Honeywell Inc., Minneapolis, Minn.

[21] Appl. No.: 610,756

[22] Filed: Nov. 8, 1990

[51] Int. Cl.[5] ..... H01P 1/15

[52] U.S. Cl. ..... 333/104; 333/262

[58] Field of Search ..... 333/103, 104, 262; 307/243, 244

[56] References Cited

U.S. PATENT DOCUMENTS

| | | | |
|---|---|---|---|
| 3,475,700 | 10/1969 | Ertel | 333/104 |
| 4,266,208 | 5/1981 | Cornish | 333/218 |
| 4,334,202 | 6/1982 | Cornish et al. | 333/218 |

FOREIGN PATENT DOCUMENTS

| | | | |
|---|---|---|---|
| 125101 | 7/1984 | Japan | 333/104 |
| 54801 | 3/1988 | Japan | 333/262 |

*Primary Examiner*—Paul Gensler

*Attorney, Agent, or Firm*—Ronald E. Champion

[57] ABSTRACT

A millimeter wave microstrip shunt-mounted PIN diode switch having its DC ground separate from RF ground is created by utilizing a fan structure (radial stub) having a radius of approximately one-quarter wavelength to provide an RF ground at that location and then coupling the DC bias supplies to that RF ground location. By doing so and by proper attention to known design practices for laying out microstrip circuitry, the need for blocking capacitors required by prior art arrangements is eliminated.

6 Claims, 1 Drawing Sheet

MILLIMETER WAVE MICROSTRIP SHUNT-MOUNTED PIN DIODE SWITCH WITH PARTICULAR BIAS MEANS

U.S. GOVERNMENTAL RIGHTS

The U.S. Government has contributed to the design and development of this invention and, therefore, has obtained certain rights therein.

BACKGROUND OF THE INVENTION

I. Field of the Invention

This invention relates generally to electronic switching means, and more particularly to an improved microstrip shunt-mounted PIN diode switch for use at millimeter wave frequencies and having a DC biasing arrangement which obviates the need for blocking capacitors for isolating the DC bias voltage from the RF circuitry with which the switch is intended to be used.

II. Discussion of the Prior Art

In high frequency work, so-called microstrip technology is used in implementing a wide number of electronic circuit devices. Such a microstrip typically comprises an insulating substrate having a conductive ground plane adhered to one surface thereof and an etched conductive pattern on the other major surface. By properly following the design rules which associate operating frequencies with geometries, the etched pattern can be used to create electronic circuits including distributed capacitors and inductors whose impedance values at the operating frequencies can be tailored to meet desired circuit requirements. The etched microstrip patterns may also be utilized in combination with active components, e.g., Gunn diodes, IMPATT diodes, etc., to yield high frequency oscillators having sufficient power to drive antennas in radar systems and the like. Because of their physical makeup, microstrip circuits tend to remain quite stable and are often employed where size constraints will not permit other technologies employing discrete components to be used.

In certain radar applications, a need exists for switching an RF source between a plurality of antennas and, alternatively, coupling a received signal from plural antennas to a single receiver. There is disclosed in the prior art, a millimeter wave shunt-mounted PIN diode switch in which the DC ground for the bias sources and the RF ground are common. In this design, the DC ground and the RF ground are both the ground plane of the microstrip device. It then becomes necessary to include a number of DC blocking capacitors in circuit with the microstrip to prevent the DC bias current used to switch the PIN diodes from flowing into the sources or loads and to isolate the biases of each diode from one another.

Referring to FIG. 1, which shows a prior art arrangement of a millimeter wave shunt-mounted PIN diode switch designed to couple an RF input to one or the other of a pair of outputs, first and second bias supplies are used to control the on/off state of the PIN diodes. When a diode is forward biased, it presents a low loss to RF energy but when reversed biased affords a high impedance. Thus, for example, if the DC biases no. 1 and no. 2 are such that the PIN diode no. 1 is forward biased, while PIN diode no. 2 is reverse biased, the RF output will appear at output no. 2 because output no. 1 is effectively held at RF ground potential. On the other hand, if the bias is such that it is diode no. 2 that is forward biased and diode no. 1 that is reverse biased, then the RF input will be switched to output no. 1.

It is to be especially noted relative to the prior art circuit of FIG. 1 that four blocking capacitors $C_1$ through $C_4$ are required to block the DC bias current from flowing back into the input source, the output loads and for preventing the DC bias from source no. 1 from reaching PIN diode no. 2 or the bias from DC source no. 2 from reaching the PIN diode no. 1. Because the DC voltage required to bias the diodes is conducted by the microstrip transmission lines, to isolate the bias voltages from one another, the DC blocking capacitors are incorporated and are designed to pass the RF frequency signals while inhibiting the DC bias current flow. Those skilled in the art will appreciate, however, that the presence of these blocking capacitors tends to add additional loss to the performance of the switch. In addition, because they are high-frequency components, they tend to be very small and somewhat expensive, thus adding to the material and labor costs of fabricating the switch. Moreover, in certain microminiaturized electronic packaging applications, the inclusion of discrete blocking capacitors is prohibited because of the space constraints imposed. Moreover, the circuit incorporating the discrete component blocking capacitors may exhibit decreased reliability, especially under high G forces or vibration.

OBJECTS

It is accordingly a principal object of the present invention to provide a millimeter wave microstrip shunt-mounted PIN diode switch with a unique biasing means which obviates the need for blocking capacitors heretofore required in prior art designs.

Another object of the invention is to provide a millimeter wave microstrip shunt-mounted PIN diode switch with separate DC and RF ground points.

Yet another object of the invention is to provide a millimeter wave microstrip shunt-mounted PIN diode switch exhibiting very low loss and which is easier to produce than known prior art arrangements.

SUMMARY OF THE INVENTION

The foregoing objects and advantages are achieved in accordance with the present invention by providing a microstrip pattern which allows sharing of the DC bias line with a RF ground structure so that the entire microstrip structure is at a common dc potential, thereby dispensing with the need for blocking capacitors. RF ground points are obtained by providing an etched fan pattern at appropriate points in the microstrip and then coupling the DC bias to these RF ground points while providing a separate DC ground connection between the microstrip pattern and the ground plane of the microstrip circuit.

DESCRIPTION OF THE DRAWINGS

The foregoing features and advantages of the invention will become apparent to those skilled in the art from the following detailed description of a preferred embodiment, especially when considered in conjunction with the accompanying drawings in which like numerals in the several views refer to corresponding parts.

DESCRIPTION OF THE PREFERRED EMBODIMENT

Figure 2:
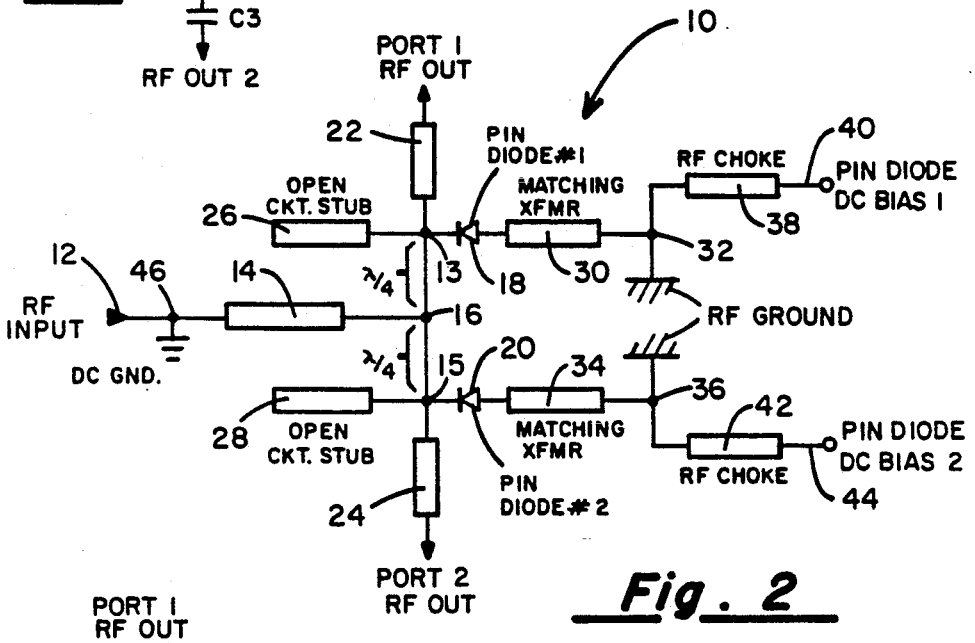
FIG. 2 is an electrical schematic diagram of a single-pole, double-throw millimeter wave microstrip shunt-mounted PIN diode switch incorporating the improved bias means of the present invention.

Referring first to FIG. 2, the millimeter wave microstrip shunt-mounted PIN diode switch incorporating an improved biasing arrangement is illustrated and is identified generally by numeral 10. It includes an RF input point 12 which is coupled through an impedance matching transformer !4 to a switch point 16. Displaced a quarter wavelength away on opposite sides of the switch point 16 and joined to the transmission line segment are a first electrode of a pair of PIN diodes 18 and 20.

While in FIG. 2, it is the cathode electrode that is shown as being coupled to the microstrip transmission line, the diodes can be reversed if an opposite polarity bias source is employed.

Matching transformers 22 and 24 couple the first electrodes of the PIN diodes 18 and 20 to first and second RF output ports labeled "Port 1" and "Port 2". Open circuit stubs, as at 26 and 28, are also coupled to that first electrode of the PIN diodes 18 and 20. The second electrode of the PIN diode 18 is coupled by means of a matching transformer 30 to an RF ground point 32. Likewise, the other electrode of the PIN diode 20 is coupled by a matching transformer 34 to a RF ground point 36. A RF choke 38 leads to a terminal 40 to which the DC bias supply for PIN diode 18 is connected. In a similar fashion, RF choke 42 couples the RF ground point 36 to terminal point 44 to which the DC bias source for PIN diode 20 is connected. The ground for the DC bias is shown as being connected at junction 46 between the RF input terminal 12 and the matching transformer 14. It can, however, be electrically joined to the etched microstrip pattern anywhere along the length of the segment between points 12 and 16, or be incorporated in the electrical circuit which connects to the RF input 12.

The invention is illustrated as being applied to a single-pole, double-throw switch configuration whereby the RF input at terminal 12 may be switched either to the Port 1 RF output or the Port 2 RF output depending upon the bias applied to the PIN diodes 18 and 20. If PIN diode 18 is forward biased and PIN diode 20 is reverse biased by the DC bias voltages applied at terminals 40 and 44, the RF output will appear at Port no. 2. Conversely, if the PIN diodes 18 and 20 are biased such that diode 18 is reverse biased and diode 20 is forward biased, then the RF input will be switched to the Port 1 RF output terminal. This is due to the fact that the switch point 16 is displaced from the junction points 13 and 15 by a transmission line having a length $\lambda/4$. Hence, when junction 13 is at RF ground due to the forward biasing of the PIN diode 18, that length of transmission line appears as an open circuit at switch point 16, whereas if the junction point 15 is looking at a high impedance, the transmission line between junctions 15 and 16 appears as a through circuit. The principles of this invention can readily be extended to a single-pole, N-throw switch.

Figure 3:
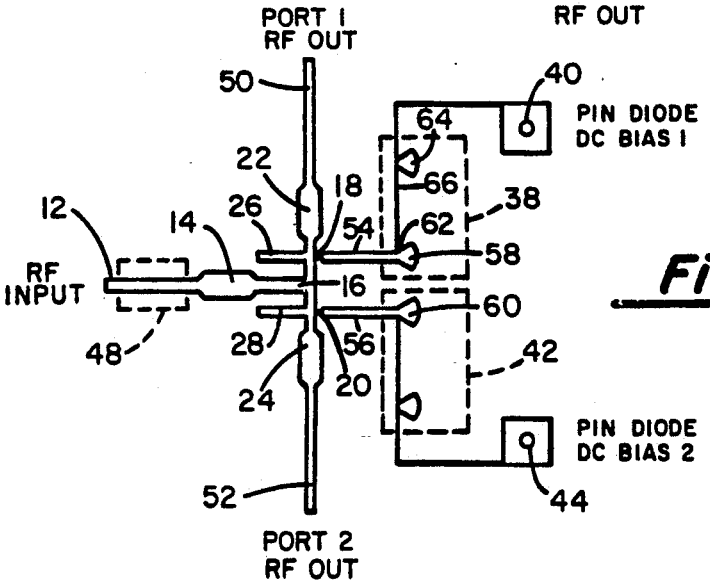
FIG. 3 shows the microstrip circuit pattern for implementing the schematic diagram of FIG. 2.

Referring now to FIG. 3, the microstrip circuit pattern is shown in a plan view. That is, the pattern shown in FIG. 3 will be etched from a conductive material, such as copper, adhered to one surface of a dielectric substrate. The other surface of the substrate is uniformly covered by a continuous conductive ground plane. The dimensions of the various metal segments comprising the pattern of FIG. 3 are dimensioned such that the portion enclosed by broken line box 48 comprises a 50 ohm line and the slightly larger segment identified by numeral 14 is a matching transformer used to match the switch junction 16 to the 50 ohm line enclosed by the broken line box 48.

The PIN diodes 18 and 20 are disposed one-quarter wavelength away from the switch point 16 on opposite sides thereof and the matching transformers comprising the enlargements 22 and 24 on the transmission lines 50 and 52 match the switch junctions to the impedance of lines 50 and 52 (50 ohms). The PIN diodes 18 and 20 exhibit a capacitive reactance at the millimeter wave frequencies involved. The open circuit stubs 26 and 28 are dimensioned so as to behave as an inductor at the frequencies involved and are designed to have a value for resonating or nulling the capacitive reactance of the associate PIN diode. The conductive segments 54 and 56 are dimensioned so as to act as short circuit stubs having a capacitive reactance for resonating or nulling any inductive reactance of their associated PIN diodes 18 or 20.

Contiguous with the short circuit stubs 54 and 56 are etched fans (radial stubs) 58 and 60 which at the outer periphery thereof appear as an open circuit for RF frequencies. If the radius of the fan segment is approximately one-quarter wavelength, the narrowest portion of the fan, i.e., the neck 62, will behave as an RF ground. It is to this point that the PIN diode DC bias sources are connected. More specifically, the DC bias terminal 40 for PIN diode 18 is coupled through an RF choke 38 to the neck 62 of fan 58. The RF choke is comprised of the etched fan segment 64 and a transmission line segment 66. It functions as a filter for keeping RF signals off of the DC line.

In that the circuit of FIG. 3 is symmetrical, the foregoing explanation of the manner in which the DC bias for PIN diode no. 1 connects into a RF ground point, it is believed unnecessary to explain in detail the manner in which the DC bias for PIN diode 20 is configured, the two being identical.

The DC ground point 46 is not specifically shown in FIG. 3 but comprises a through conductor electrically joining the portion of the microstrip pattern including the transmission line 48 or the matching transformer 14 to the ground plane of the microstrip assembly. A DC bias current can then flow from the bias source connected to point 40, through the RF choke 38, through the short circuit stub 54, through the PIN diode 18, and through the remainder of the conductive pattern to the DC ground point. Likewise, the DC bias for PIN diode no. 2 is connected between the DC ground point and the terminal 44 allowing the bias current to flow through the RF choke 42 and the short circuit stub 56 coupling the fan 60 to the PIN diode 20, through the PIN diode 20 and the remaining portion of the conductive microstrip pattern leading to the DC ground point.

Figure 1:
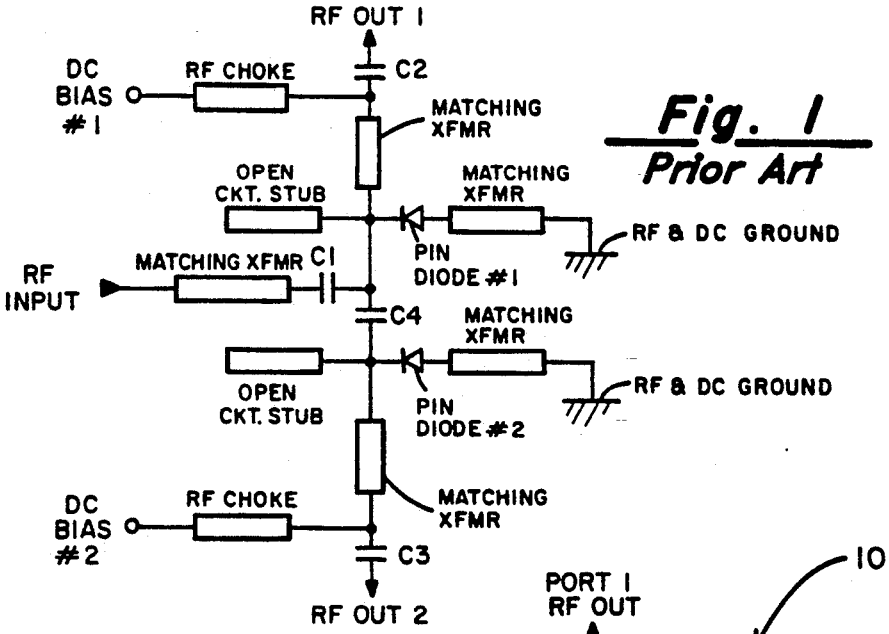
Fig. 1 Prior Art
FIG. 1 is an electrical schematic diagram of a prior art single-pole, double-throw millimeter wave microstrip shunt-mounted PIN diode switch.

A key feature of the invention lies in recognizing that by incorporating the fan segments 58 and 60, a RF ground point is established at the neck thereof when the fan radius is approximately a quarter wavelength and that by coupling the DC bias lines to that point, the DC ground can be located remote therefrom. Because the microstrip transmission lines are DC grounded, but not RF grounded, the need for DC blocking capacitors on the microstrip lines, as in the prior art, is eliminated. The single-pole, double-throw switch of the present invention has a reduced parts count as compared to the prior art arrangement of FIG. 1 and, moreover, assembly labor is correspondingly reduced. By eliminating the blocking capacitors, lossy circuit elements are eliminated and physical size is reduced.

This invention has been described herein in considerable detail in order to comply with the Patent Statutes and to provide those skilled in the art with the information needed to apply the novel principles and to construct and use such specialized components as are required. However, it is to be understood that the invention can be carried out by specifically different equipment and devices, and that various modifications, both as to the equipment details and operating procedures, can be accomplished without departing from the scope of the invention itself.

What is claimed is:

1. A millimeter wave microstrip shunt-mounted PIN diode switch comprising:

(a) a source of RF input signals of millimeter wavelength;

(b) first and second sources of DC bias voltage;

(c) a microstrip circuit including a ground plane, an insulating substrate having first and second major surfaces, said first major surface being affixed to said ground plane and an etched conductor pattern affixed to said second major surface of said insulating substrate, said pattern including etched matching transformer means for coupling said source of RF signals to a switch point and said switch point to at least two output terminals;

(d) first and second PIN diodes each having one electrode thereof coupled between said switch point and a different one of said two output terminals and spaced from said switch point by a distance of $\lambda/4$, where $\lambda$ is the wavelength of said RF input signals; and (e) said pattern further including first and second fan segments individually coupled to the other electrode of said first and second PIN diodes by further matching transformer means, said first and second fan segments providing an RF ground point for said source of RF input signals, to thereby block said RF signal from reaching said first and second sources of DC bias voltage.

2. The millimeter wave microstrip shunt-mounted PIN diode switch as in claim 1 and further including conductor means connecting said pattern to said ground plane to form a DC ground point whereby said pattern is at a common DC potential.

3. The millimeter wave microstrip shunt-mounted PIN diode switch as in claim 2 wherein said DC ground point is separate from said RF ground point.

4. A millimeter wave microstrip shunt-mounted PIN diode switch comprising:

(a) a source of RF input signals of millimeter wavelength;

(b) first and second sources of DC bias voltage;

(c) a microstrip circuit including a ground plane, an insulating substrate having first and second major surfaces, said first major surface being affixed to said ground plane and an etched conductor pattern affixed to said second major surface of said insulating substrate, said pattern including etched matching transformer means for coupling said source of RF signals to a switch point and said switch point to at least two output terminals;

(d) first and second PIN diodes each having one electrode thereof coupled between said switch point and a different one of said two output terminals and spaced from said switch point by a distance of $\lambda/4$, where $\lambda$ is the wavelength of said RF input signals; and (e) said pattern further including first and second fan segments individually coupled to the other electrode of said first and second PIN diodes by further matching transformer means, said first and second fan segments providing an RF ground point for said source of RF input signals, to thereby block said RF signal from reaching said first and second sources of DC bias voltage said pattern also including first and second open circuit stub means individually coupled to said one electrode of said first and second PIN diodes for providing an inductive reactance sufficient to null any capacitance reactance exhibited by said PIN diodes at the frequency of said RF signals.

5. A millimeter wave microstrip shunt-mounted PIN diode switch comprising:

(a) a source of RF input signals of millimeter wavelength;

(b) first and second sources of DC bias voltage;

(c) a microstrip circuit including a ground plane, an insulating substrate having first and second major surfaces, said first major surface being affixed to said ground plane and an etched conductor pattern affixed to said second major surface of said insulating substrate, said pattern including etched matching transformer means for coupling said source of RF signals to a switch point and said switch point to at least two output terminals, wherein said etched matching transformers coupling said source of RF signals to said switch point and said switch point to said first and second output terminals matches said switch point to transmission lines of a predetermined impedance;

(d) first and second PIN diodes each having one electrode thereof coupled between said switch point and a different one of said two output terminals and spaced from said switch point by a distance of $\lambda/4$, where $\lambda$ is the wavelength of said RF input signals; and (e) said pattern further including first and second fan segments individually coupled to the other electrode of said first and second PIN diodes by further matching transformer means, said first and second fan segments providing an RF ground point for said source of RF input signals, to thereby block said RF signal from reaching said first and second sources of DC bias voltage.

6. A millimeter wave microstrip shunt-mounted PIN diode switch comprising:

(a) a source of RF input signals of millimeter wavelength;

(b) first and second sources of DC bias voltage;

(c) a microstrip circuit including a ground plane, an insulating substrate having first and second major surfaces, said first major surface being affixed to said ground plane and an etched conductor pattern affixed to said second major surface of said insulating substrate, said pattern including etched matching transformer means for coupling said source of RF signals to a switch point and said switch point to at least two output terminals;

(d) first and second PIN diodes each having one electrode thereof coupled between said switch point and a different one of said two output terminals and spaced from said switch point by a distance of $\lambda/4$, where $\lambda$ is the wavelength of said RF input signals; and (e) said pattern further including first and second fan segments individually coupled to the other electrode of said first and second PIN diodes by further matching transformer means, said first and second fan segments providing an RF ground point for said source of RF input signals, to thereby block said RF signal from reaching said first and second sources of DC bias voltage, wherein said first and second fans are individually coupled to said other electrodes of said first and second PIN diodes by an etched short circuit stub means, said short circuit stub means providing a capacitive reactance for nulling any inductive reactance of said first and second PIN diodes at the frequency of said RF signals.

* * * * *